United States Patent [19]

Krebs et al.

[11] 4,351,654

[45] Sep. 28, 1982

[54] PROCESS FOR THE REMOVAL OF PRECIPITATES IN HEAT EXCHANGERS OF LOW TEMPERATURE INSTALLATIONS

[75] Inventors: Waldemar Krebs; Hermann Bromme, both of Marl, Fed. Rep. of Germany

[73] Assignee: Chemische Werke Hüls Aktiengesellschaft, Marl, Fed. Rep. of Germany

[21] Appl. No.: 217,222

[22] Filed: Dec. 17, 1980

[30] Foreign Application Priority Data

Dec. 17, 1979 [DE] Fed. Rep. of Germany ..... 2950810

[51] Int. Cl.[3] ..... F25J 3/00

[52] U.S. Cl. ..... 62/13; 62/12

[58] Field of Search ..... 62/13–15

[56] References Cited

U.S. PATENT DOCUMENTS

| | | | |
|---|---|---|---|
| 2,653,455 | 9/1953 | Etienne | 62/13 |
| 2,671,324 | 3/1954 | Trumpler | 62/14 |
| 2,753,701 | 7/1956 | Palmer et al. | 62/14 |

*Primary Examiner*—Norman Yudkoff

*Attorney, Agent, or Firm*—Antonelli, Terry & Wands

[57] ABSTRACT

A process for removing troublesome precipitates of condensable gases in a heat exchanger of a continuously operated low temperature installation in which gas to be cooled, such as air, which contains condensable gases at ambient temperature is passed from a warm end to a cold end of the exchanger through a storage material and over heat exchange surfaces—maintained at a temperature ranging from −165° C. to −160° C. at the cold end—and cold regenerator gas free of condensable gases is alternately passed from the cold end to the warm end over the storage material and heat exchanger surfaces to remove precipitates of the condensable gases therefrom in a cyclic operation, without total shutdown of the installation, involves the further step of introducing warm gas which is at a temperature of between 0° C. and +110° C. and which does not contain any condensable gases briefly at the cold end of the heat exchanger so as to remove precipitates remaining within the heat exchanger after a continuous period of the cyclic operation.

8 Claims, 1 Drawing Figure

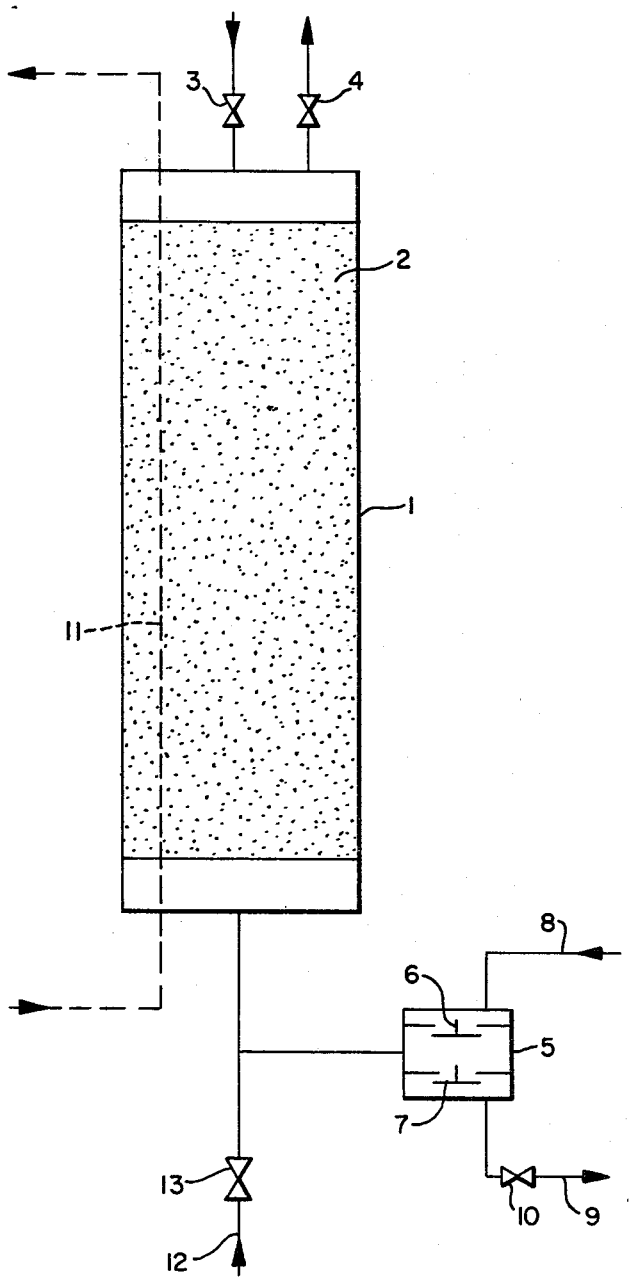
3
4
2
1
11
8
6
5
7
13
10
9
12

PROCESS FOR THE REMOVAL OF PRECIPITATES IN HEAT EXCHANGERS OF LOW TEMPERATURE INSTALLATIONS

This invention relates to heat exchangers for use in low temperature installations; these heat exchangers are either exchangers filled with a storage material, i.e. the regenerators, or are recuperators operated as reversing heat exchangers. The object of the invention is to remove, in an economical manner, the precipitates which form, at low temperatures, on the heat exchange surfaces and on the storage material of these types of heat exchangers.

In low temperature technology, heat exchangers are employed to cool gases which contain condensable constitutents ("moist gases"). During a cyclic warm period, wherein the gases to be cooled are introduced, the condensable constitutents precipitate, within certain temperature ranges, on the storage material and on the heat exchange surfaces. For example, on cooling moist air, water condenses on the storage material at the warm end of a regenerator, as soon as the air has cooled to below its dew point; this precipitate is converted to ice wherever the storage material is colder than 0° C. At the cold end of a regenerator, in the temperature range of between about −120° C. and −140° C., carbon dioxide sublimes and there $CO_2$ snow forms. Corresponding precipitates form in recuperators operated as reversing heat exchangers; for simplicity, however, only the processes which occur in the regenerator will be described below.

In the cold period of the operating cycle, these precipitates are removed again by a cold regenerator gas passing into the cold end of the regenerator. The duration of the warm period and of the cold period is a parameter specific to the particular installation. In general, the cold period in low temperature installations is somewhat longer than the warm period of the operating cycle, so as to remove all the percipitates as completely as possible by the end of the cold period. However, as experience, for example with air-operated low temperature installations, has shown, the flow resistance of the regenerators in continuous cyclic operation progressively increases over the course of several months, and as a result the gas throughput of the regenerators, and hence the efficiency of the installation, gradually declines. For this reason it is hitherto virtually unavoidable to defrost the regenerators completely after a period of operation of about one year, that is to say to warm the regenerators, and hence the entire low temperature installation, to ambient temperature and flush it with gas.

As long as the defrosting process can be coupled with a shutdown of the entire installation which for some reason is necessary in any case, it is not objectionable. In the past, however, the duration of operation of low temperature installations designed for continuous operation has, as far as the requirements of the apparatus are concerned, been increased to several years; hence, it is desired to avoid any defrosting process which has to take place between two shut-downs of the entire installation, occasioned by the requirements of the apparatus. Particularly in large installations designed for continuous operation, total shut-downs are time-consuming and additionally require a large expenditure of energy.

Accordingly, there is the task during the several years' continuous operation of a large low temperature installation, of bringing the regenerators, whose gas throughput has decreased excessively relative to the inital value, under unchanged operation conditions, due to incompletely removed precipitates of condensable constitutents, back to approximately the initial value of the gas throughput, without total shut-down of the entire installation.

According to the invention, this task is solved by briefly introducing for a period of e.g. from 1,5 to 4 hours, at the cold end of the heat exchanger, warm regenerator gas which is at a temperature of between 0° C. and +110° C. and does not contain any condensable constitutents. This flushing of the heat exchanger is carried out between two total shut-downs of the installation due to the requirements of the apparatus, i.e. at a time interval of several months. It is true that in doing so, the entire low temperature installation is taken out of operation for a few hours, e.g. 4 to 6 hours. However, the low temperature part of the installation remains at its low temperature, and, on average, the regenerators become less warm than in the case of a total shut-down. The entire installation can be returned to full capacity after only a few hours.

The warm gas is introduced as near as possible to the cold end of the regenerator, for example in the valve box or between the valve box and the end of the regenerator. It leaves the regenerator via the simultaneously opened outlet flaps at the warm end, the regenerator remaining approximatley at atmospheric pressure.

Further, it has proved of value initially to keep the outlet flaps at the warm end of the regenerator closed and to bring the regenerator, by introduction of the warm gas, to a pressure which is below the pressure prevailing in the regenerator during a warm period of cyclic operation. If the valves in the valve box are insufficiently tightly closed, the pressure in the low pressure zone of the low temperature part of the installation must, however, not rise to the pressure at which the safety valve present in the low pressure zone responds. After this pressure has been maintained in the regenerator for a brief period, the gas in the regenerator is released, as abruptly as possible, via the outlet flaps at the warm end of the regenerator.

In the case of heat exchangers which can be switched back, the warm gas can also be admixed, during a cold period of an operating cycle, to the cold regenerator gas before this cold gas enters the cold end of the regenerator.

The proportion of the warm gas for restoring full operation of the exchanger is between 10 and 25 percent by weight of the amount of cold gas and the temperature of the warm gas is between 0° C. and +110° C. In order that it should be possible to switch the regenerator directly back to a warm period at the end of this cold period, the regenerator must not be warmer than −155° C. at the cold end. In this procedure, the capacity of the low temperature installation remains virtually fully preserved. However, in this procedure of using a mixture of warm and cold gas, the precipitates in the regenerator are not as extensively removed as by insufflation or injection of warm gas alone.

The warm gas must be free from condensable constitutents; it is produced, for example, by vaporising a suitable liquefied gas, i.e. a liquefied gas which is in any case present in the installation.

The $CO_2$ snow present near the cold end of the regenerator is removed virtually completely if, at this point, the regenerator is warmer than −110° C.

The procedure can, if required, be employed repeatedly between two complete shut-downs of a low temperature installation run on a continuous operation basis.

The warm gas required is prewarmed outside the low temperature installation and apart from the inlet nozzles for the warm gas on each regenerator, no modifications to the installation itself are required.

As long as the optimum conditions for the introduction of warm gas are not adquately known for a particular low temperature installation, it is advantageous to monitor the discharge of the troublesome precipitate, which has been reconverted to the gas phase, by means of known gas analysis instruments, whose sensors are mounted in the exit line at the warm end of the regenerator.

Since, in the process according to the invention, an additional total shut-down between two total shut-downs occasioned by the requirements of the apparatus is avoided, substantial amounts of energy can be saved by means of the process.

The process according to the invention is illustrated by the examples which follow, which relate, by way of example, to the following continuously operated low temperature installation for air separation:

The installation comprises 7 regenerators each of about 90 $m^3$ empty volume, and each filled with about 120 tons of quartz rock as the storage material. The installation takes up about 179 tons/hour (corresponding to about 140,000 $m^3m$/hour) of air and releases the following amounts:

25 tons/hour of pure gaseous nitrogen at 6 bar and +15° C.

21 tons/hour of pure gaseous oxygen at 1.1 bar and +15° C.

1.3 tons/hour of pure liquid nitrogen at 6 bar and −176° C.

1.5 tons/hour of pure liquid oxygen at 1.1 bar and −177° C.

130.2 tons/hour of cold gas (during the cold period of the regenerators).

The installation has a power of about 13 MW (corresponding to about 476 GJ/h). The period of operation of the apparatus between two total shut-downs is 4 years.

The warm period, i.e. when the air is being cooled, for each regenerator is 10 minutes and the cold period, i.e. when the exchanger is being regenerated by removal of precipitated or solidified gases, is 13 minutes. In steady state conditions, the temperatures at the regenerator ends are, for example:

| | warm end | cold end |
|---|---|---|
| End of cold period / Start of warm period | +20° C. | −165° C. |
| End of warm period / Start of cold period | +25° C. | −160° C. |

The air to be cooled is introduced at a temperature of from 25° C. to 30° C. and leaves the regenerator at its cold end at a temperature ranging from −158° C. to −163° C. The cooling medium, e.g. impure nitrogen gas, is introduced at the cold end at −172° C.

COMPARATIVE EXAMPLE

The operating period between two total shut-downs of the installatiion, for the purpose of defrosting the regenerators, is about one year. The time required for shutting down, defrosting the regenerators and starting up is at least 6 days and requires an energy consumption of about 800 MWh (corresponding to about 2,880 GJ).

EXAMPLE 1

Flusing the Regenerators with Warm Gas

After about one year's continuous operation, the installation is taken out of operation as follows: the air supply to the regenerators is stopped and the low temperature zone is shut off from the cold regenerator gas supply. Warm gas, namely nitrogen gas which has been produced from liquid nitrogen and has been warmed to about +17° C., is introduced simultaneously into all regenerators. Each regenerator is flushed for about 1.5 hours with 4.6 tons/hour of warm gas, at approximately atmospheric pressure. The $CO_2$ content in the exit line is measured continuously. The following results were obtained:

| Regenerator No. | Air throughput before flushing $m^3$/hour | $CO_2$ content at the maximum ppm | Air throughput after flushing $m^3$/hour |
|---|---|---|---|
| 1 | 17,800 | 310 | 19,600 |
| 2 | 18,200 | 250 | 19,900 |
| 3 | 18,300 | 240 | 19,700 |
| 4 | 19,500 | 100 | 19,800 |
| 5 | 17,400 | 280 | 19,700 |
| 6 | 18,100 | 270 | 19,500 |
| 7 | 17,200 | 350 | 19,800 |
| | 126,500 | | 138,000 |

The "$CO_2$ content at the maximum" is the maximum value of the $CO_2$ content recorded on a pen recorder versus time.

The regenerator No. 4 was evidently covered with relatively little $CO_2$ snow. After flushing with warm gas, all the regenerators again show the normal throughput of 19,500 to 20,000 $m^3$/hour. Cooling the regenerators to −165° C. at the cold end requires about 3 hours. After 5.2 hours, the installation again possesses its full capacity. The energy requirement for this procedure is about 44 MWh.

EXAMPLE 2

Addition of Warm Gas During a Cold Period

In a regenerator, 3.8 tons/hour of nitrogen gas which is at +17° C. and does not contain any condensable constitutents are introduced, from the start of the cold period, additional to the cold gas. The cold period lasts 13 minutes. The temperature of the regenerator at the cold end rises from −160° C. to −157° C. during this cold period. The throughput of the regenerator before this cold period was 17,200 $m^3$/hour, whilst after this cold period it rose to 18,600 $m^3$/hour. Accordingly, the throughput has increased less markedly than in the process according to Example 1.

The attached sole FIGURE of the drawing, which is a schematic view of a regenerator, shows a regenerator 1 of an air-operated low temperature installation filled with the storage material 2, e.g. quartz rock. The inlet flap or valve 3 for the air and the outlet flap 4 are located at the warm end of the regenerator, i.e. at the upper end, and the valve box 5, which contains the non-return valves 6 and 7, is attached to the cold end of the regenerator. Line 8 is the feed line for cold regenerator gas. Line 9 is the take-off line for cooled air; this line contains a valve 10. Either cold pure oxygen gas or nitrogen gas for providing the cooling effect flows through the metal tubes located in the storage material, of which one tube is designated by reference numeral 11. This gas enters at the cold end of the regenerator, leaves the regenerator at the warm end and is passed on to further usage. The line 12 and the valve 13 serve for the introduction of warm gas, in accordance with the invention.

During the warm period, air to be cooled flows via the inlet flap 3 into the storage material 2, there becomes cooled, leaves the regenerator via the open non-return valve 7 and flows via the line 9 and the open valve 10 to the low temperature part of the installation; during this procedure, the outlet flap 4 and the non-return valve 6 are closed.

During a cold period, cold regenerator gas flows via the line 8 and the open non-return valve 6 to the cold end of the regenerator, cools the storage material and flushes out the precipitates present on the storage material. The cold gas leaves the regenerator via the outlet flap 4 and passes into the atmosphere via a silencer; during this procedure, the inlet flap 3 and the non-return valve 7 are closed as a result of the counter-pressure present in the line 9.

The cold gas comes from the low temperature part of the installation and consists predominantly of nitrogen; in addition, it contains oxygen and noble gases, but no condensable consitutents.

The valve 13 is closed during the continuous operation of the installation. To introduce warm gas for restoring full operation of the installation, the valve 10 and the inlet flap 3 are closed; the valve 13 is opened, whereupon the non-return valve 6 closes. The warm gas leaves the regenerator via the outlet flap 4.

What is claimed is:

1. A process for removing troublesome precipitates of condensable gases in a heat exchanger of a continously operated low temperature installation wherein gas to be cooled which contains condensable gases at a temperature of e.g. from 25° C. to 30° C. is passed from the warm end to the cold end of the exchanger through a storage material and over heat exchange surface, maintained at a temperature ranging from −165° C. to −160° C. at the cold end, and cold regenerator gas free of condensable gases is alternately passed from the cold end to the warm end over the storage material and heat exchanger surfaces to remove precipitates of the condensable gases therefrom in a cyclic operation, without total shut-down of the installation, characterized in that warm gas which is at a temperature of between 0° C. and +110° C. and which does not contain any condensable gases is introduced briefly at the cold end of the heat exchanger and is passed over the heat exchanger surfaces and through the storage material to remove precipitates of the condensable gases.

2. A process according to claim 1, wherein the warm gas under approximately atmospheric pressure is allowed to flow through the heat exchanger from the cold end to the warm end.

3. A process according to claim 1, wherein the warm gas is introduced into the heat exchanger until a predetermined pressure is reached, and the gas present under pressure in the heat exchanger is then abruptly released from the exchanger.

4. A process according to claim 1, wherein the warm gas is admixed to the cold gas during a cold period of the heat exchanger and the flow of the gas to be cooled is stopped during said cold period.

5. A process according to one of claims 1 to 4, wherein anhydrous and $CO_2$-free gas, which essentially consists of nitrogen with at most 30% by weight of oxygen, is used as the warm gas in an air-operated low temperature installation including said heat exchanger.

6. A process according to claim 1, wherein the cyclic operation is stopped during introduction of the warm gas.

7. A process according to claim 1, wherein the gas to be cooled is air, and the warm gas or the cold regenerator gas consists essentially of nitrogen or a mixture consisting essentially of nitrogen as a major constituent and oxygen and noble gases.

8. A process according to claim 1, wherein the passage of the gas to be cooled from the warm end to the cold end of the heat exchanger is stopped during introduction of said warm gas.

* * * * *